US007442153B1

(12) United States Patent
Chasnov

(10) Patent No.: US 7,442,153 B1
(45) Date of Patent: Oct. 28, 2008

(54) EXERCISE AND/OR REHABILITATION MACHINE

(76) Inventor: Marc A. Chasnov, 63 Bowman Ave., Rye Brook, NY (US) 10573

( * ) Notice: Subject to any disclaimer, the term of this patent is extended or adjusted under 35 U.S.C. 154(b) by 0 days.

(21) Appl. No.: 11/680,816

(22) Filed: Mar. 1, 2007

(51) Int. Cl.
*A63B 26/00* (2006.01)

(52) U.S. Cl. ..... 482/142; 482/140

(58) Field of Classification Search ..... 482/142, 482/907, 140, 91; 601/23–24, 27
See application file for complete search history.

(56) References Cited

U.S. PATENT DOCUMENTS

| | | | | | |
|---|---|---|---|---|---|
| 3,075,518 | A | * | 1/1963 | Sellner | 601/24 |
| 3,315,666 | A | * | 4/1967 | Sellner | 601/24 |
| 3,489,142 | A | * | 1/1970 | Golay | 606/245 |
| D219,745 | S | * | 1/1971 | Windscheffel | D21/690 |
| 3,716,230 | A | | 2/1973 | Mark | |
| 3,722,507 | A | * | 3/1973 | Krause | 606/237 |
| 3,761,081 | A | * | 9/1973 | Simmons | 482/142 |
| 4,157,089 | A | * | 6/1979 | Loughrey | 606/245 |
| 4,292,962 | A | * | 10/1981 | Krause | 606/244 |
| 4,387,894 | A | * | 6/1983 | Baumann | 482/112 |
| 4,461,287 | A | * | 7/1984 | Takahashi | 482/144 |
| 4,703,929 | A | * | 11/1987 | Reed | 482/144 |
| 4,753,438 | A | * | 6/1988 | Paris et al. | 482/144 |
| 5,050,589 | A | * | 9/1991 | Engle | 601/26 |
| 5,066,003 | A | * | 11/1991 | Jones | 482/137 |
| 5,163,890 | A | * | 11/1992 | Perry, Jr. | 482/142 |
| 5,232,426 | A | * | 8/1993 | Van Straaten | 482/123 |
| 5,356,359 | A | * | 10/1994 | Simmons | 482/97 |
| 5,669,860 | A | * | 9/1997 | Reyes | 482/97 |
| 5,681,250 | A | | 10/1997 | Hoover et al. | |
| 5,769,767 | A | * | 6/1998 | Hochberg et al. | 482/142 |
| 5,902,220 | A | * | 5/1999 | Lin | 482/142 |
| 6,491,607 | B2 | * | 12/2002 | Simmons et al. | 482/93 |
| 6,575,884 | B1 | * | 6/2003 | Eazor | 482/140 |
| 6,976,943 | B1 | * | 12/2005 | Hsiung | 482/141 |
| 2002/0165071 | A1 | | 11/2002 | Wu | |
| 2003/0199372 | A1 | * | 10/2003 | Robinson et al. | 482/140 |
| 2004/0067831 | A1 | * | 4/2004 | Hou | 482/140 |
| 2005/0266973 | A1 | | 12/2005 | Chen | |

* cited by examiner

*Primary Examiner*—Lori Amerson
(74) *Attorney, Agent, or Firm*—Richard M. Goldberg

(57) ABSTRACT

An exercise and/or rehabilitation machine includes a support having a rounded upper surface for supporting a person's anterior pelvic area. A first extension arm is pivotally connected to the support at a fixed pivot point and has a bar at a free end thereof as a first force resistance arrangement and a cushion at the free end thereof for engagement by a person's lower body. A second extension arm is pivotally connected to the support at a fixed pivot point and has a bar at a free end thereof as a second force resistance arrangement and a cushion at the free end thereof for engagement by a person's upper body while the first extension is engaged by the person's lower body.

15 Claims, 5 Drawing Sheets

EXERCISE AND/OR REHABILITATION MACHINE

BACKGROUND OF THE INVENTION

The present invention relates generally to an exercise and/or rehabilitation machine, and more particularly, is directed to an exercise and/or rehabilitation machine that bilaterally strengthens the upper, middle and lower posterior (truncal) extension muscles.

In normal childhood development, all infants pass though a motor development sequence that strengthens and reinforces the extension or posterior/dorsal muscles or posterior truncal extension muscles of the body. This serves multiple purposes.

First, it is neuromuscularly and neurophysiologically normal to counter the more primitive reflexive flexion posture that originates from birth. The flexion posture is represented by the anterior/ventral curled-up/fetal position at birth which lasts for the first few months of life. The onset of the extension/posterior/dorsal muscles, the pivot prone position, assists the infant in breaking out of the dominant primitive flexion posture. This allows the infant to strengthen the extensor musculature while simultaneously introducing rotation (rolling) in its normal development.

Second, the time spent in the extension movement pattern in normal development is so minor in relation to the total life span of the individual. The duration of the extension/pivot prone position in the infant is approximately four months. This four months is the only time in the individual's life when the posterior extension muscles are intrinsically developed.

Third, the extension pattern is strongest when the infant is most centrically aligned. This occurs when the infant is short in length and narrow in girth. As the infant/child grows in length and girth there is a reduction in the effectiveness of the nervous and muscular systems to maintain their central control. The support from the extension musculature is significantly reduced. This results in a less competent level of extensor strength in all functional activities of daily living, especially the upright/standing posture.

Thus the redirection of the primitive flexion pattern to extension, the small period of time spent in the extension pattern relative to the total life span, and the reduced efficacy of the extension pattern on the body as it matures in size and weight are all contributing factors in structural weakening of the individual. This lack of sufficient intrinsic extensor strengthening in infant development has a large negative effect on the strength of the lower back throughout an individual's life. Problems with lower back pain in adult life can be traced to the lack of complete preparation of the normal development process.

This is the result of adults suffering from lower back pain (LBP), which has become an epidemic, costing healthcare in the United States multiple millions of dollars as well as lost time in the workforce.

One way to augment or facilitate the temporally limited body extension development as an infant/child is to make a proper training device available.

For exercising a person's lower back muscles, it has been known to hold a person's legs while the person is positioned face down, and with the person's pelvic area supported on a supporting surface. The person bends or flexes his torso down to a position substantially perpendicular to his legs, and then raises his torso up to a position substantially parallel with his legs, and this exercise, known as a hyperextension exercise, is repeated as per accepted exercise training methods. Machines for performing this exercise are sold under the designation Glute/Ham machines. Examples of machines that can be used to perform this exercise are also disclosed in U.S. Pat. No. 5,205,804 and U.S. Pat. No. 4,391,443. This exercise can also be performed with a resistance force held at the person's upper back, as disclosed in U.S. Pat. No. 4,387,894. The entire disclosures of these patents are incorporated herein by reference.

More recently, a reverse hyperextension machine was developed by Louis J. Simmons, the subject matter of which is disclosed in U.S. Pat. No. 5,356,359 and U.S. Pat. No. 6,491,607 and the entire disclosures of which are incorporated herein by reference, which is the reverse of the aforementioned hyperextension machines. In this machine, the upper body is stabilized over the machine, and the lower body performs the work. Specifically, the legs are raised and lowered against a resistance force between a position perpendicular to the torso and a position parallel with the torso. These patents discuss the disadvantages of the hyperextension exercise, and seek to specifically avoid hyperextension of the lower back muscles, and thereby purposely direct or teach away from the hyperextension exercise.

The above hyperextension machines mostly involve the upper torso extensor musculature with minimum contribution from the lower torso extension musculature, while the reverse-hyperextension machines focus upon the lower torso extensor musculature with minimal contribution from the upper torso extensor musculature. However, no machines are known which utilize both upper torso extensor musculature and lower torso extension musculature simultaneously, that is, a total body extension machine.

A further problem with both the hyperextension and reverse hyperextension machines is that they require a person to lift a relatively large amount of weight to achieve beneficial results, which can also be harmful to the individual.

Another product that is sold under the trademark AB LOUNGE pivots at the center and extends past 180 degrees, with the person's upper body/torso and lower body/legs moving simultaneously. However, in this machine, the fulcrum where the hips of the person are positioned, moves during the exercise. The purpose of this machine is therefore to strengthen the anterior flexor muscles, that is, the abdominal muscles, rather than the posterior truncal extension.

OBJECTS AND SUMMARY OF THE INVENTION

Accordingly, it is an object of the present invention to provide an exercise and/or rehabilitation machine that overcomes the problems with the aforementioned prior art.

It is another object of the present invention to provide an exercise and/or rehabilitation machine that strengthens the posterior truncal extension muscles simultaneously.

It is still another object of the present invention to provide an exercise and/or rehabilitation machine which, because movement is more complex and involves the total body, requires less resistance to achieve the same results as the hyperextension and reverse hyperextension machines, and which is particularly beneficial in the case of children.

It is yet another object of the present invention to provide an exercise and/or rehabilitation machine which reinforces the neuromuscular system more so than either the hyperextension machine or reverse hyperextension machine.

It is a further object of the present invention to provide an exercise and/or rehabilitation machine that is compact, economical and easy to use.

In accordance with an aspect of the present invention, an exercise and/or rehabilitation machine includes a support for supporting a person's anterior pelvic area, a first extension pivotally connected to the support and extending in a first direction for engagement by a person's lower body, and a second extension pivotally connected to the support and extending in a second direction opposite to the first direction for engagement with a person's upper body while the first extension is engaged by the person's lower body.

The first extension includes a first force resistance arrangement, and the second extension includes a second force resistance arrangement. Preferably, the first force resistance arrangement and second force resistance arrangement each includes a bar at a free end of the first extension arm and second extension arm, respectively, for slidably mounting weight plates thereon.

Alternatively, at least one of the first and second force resistance arrangements includes at least one elastic cable connected between the respective extension and a fixed point.

The support has either a rounded upper surface for supporting the person's anterior pelvic area, or a flat upper surface for supporting the person's anterior pelvic area. The support also preferably has a general triangular framework.

The first extension includes a first extension arm pivotally connected to the support, and a first engagement member connected to the first extension arm for engagement by the person's lower body, and the second extension includes a second extension arm pivotally connected to the support, and a second engagement member connected to the second extension arm for engagement by the person's upper body. Preferably, each of the first and second extension arms are formed by telescoping arms to permit adjustment of a length of each respective first and second extension arm, and a securing element for securing the telescoping arms relative to each other in order to adjust the lengths of the first and second extension arms.

The first and second engagement members include cushion members at free ends of the first and second engagement members for engagement by the lower and upper body of the person, respectively. At least one of the cushion members extends generally perpendicular from the free ends of the first and second extension arms, respectively, for engagement by the lower and upper body of the person, respectively. The cushion members are mounted around axes thereof. Specifically, the first and second engagement members include a bar extending transversely through the free end of each of the first and second engagement members, and the cushion members are rotatably mounted about the respective bar. Each bar extends through opposite sides of the respective cushion member to permit weight plates to be mounted thereon as a force resistance arrangement.

Alternatively, one of the first and second extension arms includes two spaced apart and generally vertically aligned cushion members for receiving a person's legs therebetween. In addition, this same extension arm includes a footplate for receiving a person's feet therein during operation.

The second extension also includes two handles at a free end thereof for grasping by a person.

The above and other objects, features and advantages of the invention will become readily apparent from the following detailed description thereof which is to be read in connection with the accompanying drawings.

DETAILED DESCRIPTION

Figure 1:
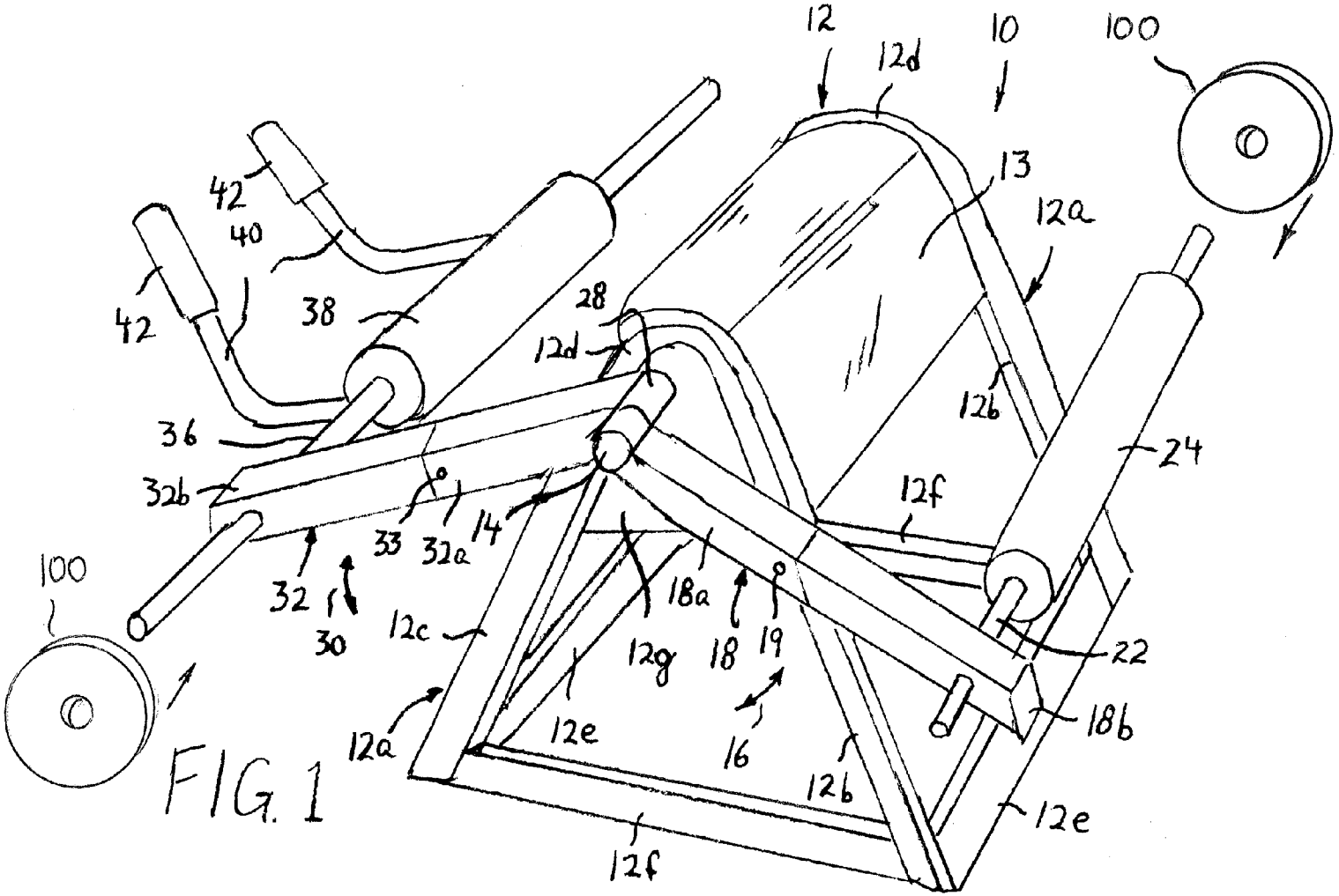
FIG. 1 is a perspective view of an exercise and/or rehabilitation machine according to the present invention.
Figure 2:
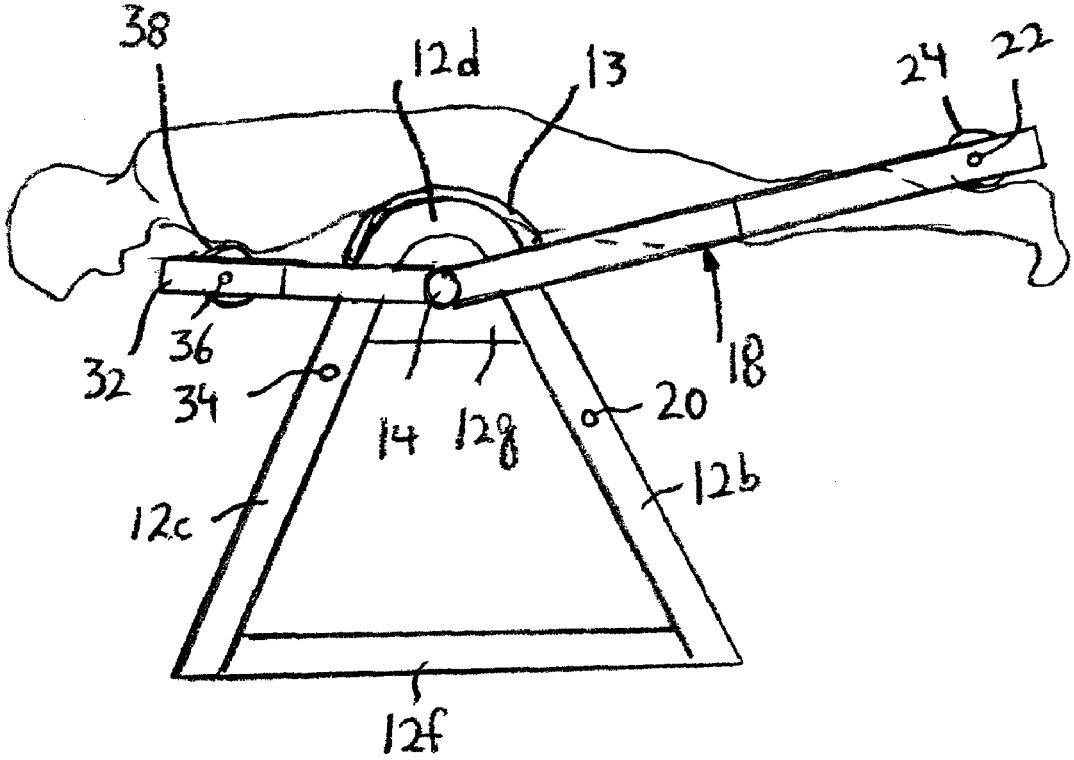
FIG. 2 is a side elevational view of the exercise and/or rehabilitation machine, showing use thereof.

Referring to the drawings in detail, and initially to FIG. 1, an exercise and/or rehabilitation machine 10 according to the present invention, includes a support 12 for supporting a person at the person's anterior pelvic area. Preferably, support 12 has a triangular shape with end supports 12*a*, each of an inverted V-shape. Each end support 12*a* thereby includes two downwardly and outwardly diverging legs 12*b* and 12*c* connected at their upper ends by an inverted U-shaped connecting leg 12*d*. Support 12 further includes two lower cross supports 12*e* which connect the lower ends of legs 12*b* together and the lower ends of legs 12*c* together. Support 12 further includes two lower cross supports 12*f* which connect the lower ends of legs 12*b* and 12*c* together. Finally, support 12 includes an upper cross support 12*g* of a generally triangular cross-sectional shape which is connected to and fits within inverted U-shaped connecting legs 12*d*. The upper end of upper cross support 12*g* is generally rounded, although it may also be a flat surface. A split cushion to allow placement of the male groin or pad 13, is fixed on the upper surface of upper cross support 12*g* between end supports 12*a* and is preferably slightly rounded for comfortably supporting the person's anterior pelvic area thereon, as shown in FIG. 2.

A pivot shaft 14 extends from one side of upper cross support 12*f* and is rotatably mounted therein. An elongated arm 18 is connected to pivot shaft 14 and extends in a direction perpendicular to the axis of pivot shaft 14 toward leg 12*b* of support 12 for rotation in the direction of double headed arrow 16. Elongated arm 18 can be formed by two telescoping arms 18*a* and 18*b* which can be set relative to each other by a pin, set screw or the like 19 to adjust the length of elongated arm 18. A stop 20 (FIG. 2) extending outwardly from leg 12*b* limits the downward travel of elongated arm 18 and sets a lower limit thereof. A roller support bar 22 extends from the free end of elongated arm 18 in a direction transverse thereto, to a position in facing relation to cushion 13. A cylindrical roller cushion 24 is rotatably mounted on roller support bar 22. As an option, although not required by the present invention, roller support bar 22 extends through the opposite side of elongated arm 18 at the free end thereof in a direction away from support 12, and can also extend to the opposite side of cylindrical roller cushion 24, whereby conventional weight-lifting plates 100 can be slidably mounted on roller support bar 22, and a well known securing collar (not shown) can be added to hold the weights on roller support bar 22.

A second pivot shaft 28 is mounted in rotatable surrounding relation on pivot shaft 14 between arm 18 and upper cross support 12*g*. An elongated arm 32 is connected to pivot shaft 28 and extends in a direction perpendicular to the axis of pivot shaft 28 toward the other leg 12*c* of support 12 for rotation in the direction of double headed arrow 30. Elongated arm 32 can be formed by two telescoping arms 32*a* and 32*b* which can be set relative to each other by a pin, set screw or the like 33 to adjust the length of elongated arm 32. A stop 34 (FIG. 2) extending outwardly from leg 12*c* limits the downward travel of elongated arm 32 and sets a lower limit thereof. A roller support bar 36 extends from one side at the free end of elongated arm 32 in a direction in front of support 12 and includes a cylindrical roller cushion 38 rotatably mounted thereon. As an option, although not required by the present invention, roller support bar 36 extends through the opposite side of elongated arm 32 at the free end thereof in a direction away from support 12, and can also extend to the opposite side of cylindrical roller cushion 38, whereby conventional weightlifting plates 100 can be slidably mounted on roller support bar 36, and a well known securing collar (not shown) can be added to hold the weights on roller support bar 36.

Further, two spaced apart L-shaped arms 40 extend from roller support bar 36 on opposite sides of cylindrical roller cushion 38, each having a grip 42 at the free end thereof.

With this arrangement, as shown in FIG. 2, a person places his anterior pelvic area on the upper surface of cushion 13. Then, the lengths of elongated arms 18 and 32 are adjusted for the individual such that cylindrical roller cushion 24 is positioned on top of the person's ankle, and the person's chest rests on cylindrical roller cushion 38. The person then grabs onto grips 42, which are not shown in FIG. 2. Appropriate weights can then added, if desired, to the ends of bars 22 and 36. The person then lifts his legs and torso up at the same time against the resistance force to exercise and strengthen the posterior truncal extension muscles.

With this arrangement, both the upper torso extensor musculature and the lower torso extension musculature are exercised and strengthened, without requiring the person to lift a relatively large amount of weight to achieve beneficial results.

As a result, contrary to both the hyperextension and reverse hyperextension machines which require a person to lift a relatively large amount of weight to achieve beneficial results, exercise and/or rehabilitation machine 110 requires less resistance to achieve the same results as the known hyperextension and reverse hyperextension machines, which is particularly beneficial in the case of children. Further, exercise and/or rehabilitation machine 10 reinforces the neuromuscular system more so than either the known hyperextension machine or reverse hyperextension machine.

It will be appreciated that, although the present invention has been discussed with relation to weight plates which are added to provide the resistance force, the present invention is not limited thereby, and any other suitable resistance device can be used. For example, coil springs can be removably connected between support 12 and elongated arms 18 and 32, dial up torsion springs can be associated with pivot shafts 14 and 28 for adjusting the resistance force, adjustable shock absorbers can be connected between support 12 and elongated arms 18 and 32, etc.

Figure 5:
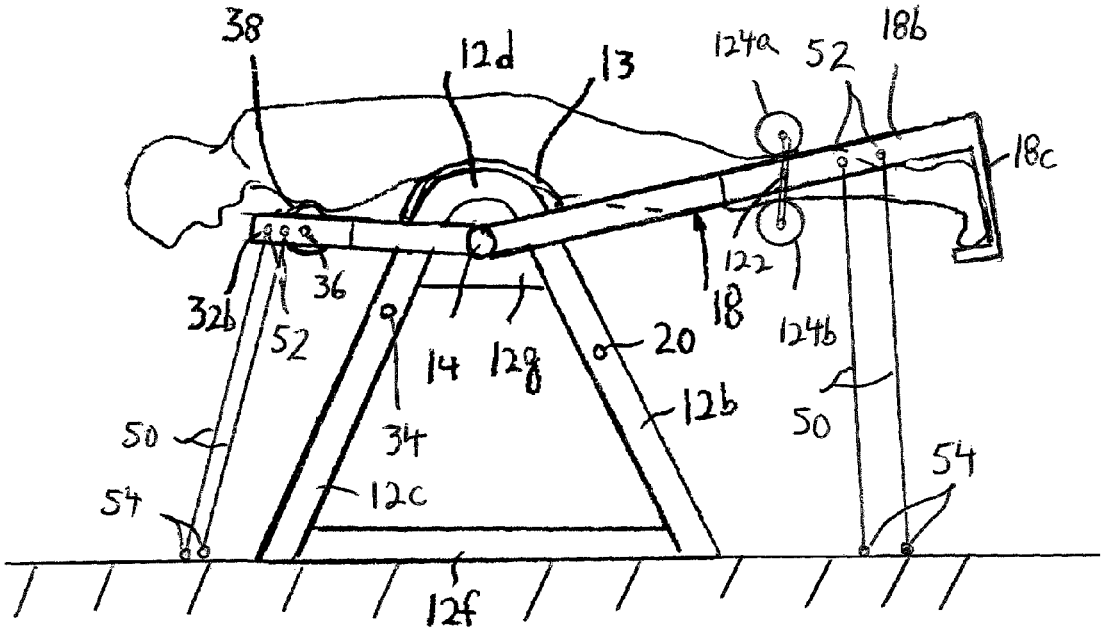
FIG. 5 is a side elevational view of a modified exercise and/or rehabilitation machine according to the present invention.

FIG. 5 shows such a modified exercise and/or rehabilitation machine according to the present invention. Specifically, rather than weight plates being used to provide the resistance force, elastic cables 50, preferably made of rubber, can be detachably connected between attaching devices 52, such as hooks, eyelets or the like at the ends of telescoping arms 18*b* and 32*b* and attaching devices 54, such as hooks, eyelets or the like at the ground surface or an extension of lower cross supports 12*f*. It will be appreciated that the number of elastic cables 50 is not limited to two for each telescoping arm 18*b* and 32*b*, and one elastic cable 50 or more than two elastic cables 50 can be used. With this arrangement, different elastic cables 50 can be selectively attached with different resistances as desired.

It will be appreciated that, if desired, rather than placing the person's chest on cylindrical roller cushion 38, arm 32 can be extended so that cylindrical roller cushion 38 is positioned on the back of the person's neck.

Further, as shown in FIG. 5, rather than using roller support bar 22 and cylindrical roller cushion 24, telescoping arm 18*b* includes a connection bar 122 secured thereto, with an upper cylindrical roller cushion 124*a* rotatably supported at an upper end thereof and a lower cylindrical roller cushion 124*b* rotatably supported at a lower end thereof, with both cushions 124*a* and 124*b* being in spaced apart, vertical alignment with each other. The placement of the cushions 124*a* and 124*b* is preferably just below the crease or joint of the knee, so that the person's legs thereat can fit between cushions 124*a* and 124*b*. In this regard, it would also be preferably to provide a footplate 18*c* to support the person's fee so that the feet could be anchored and would not dangle in space.

Figure 3:
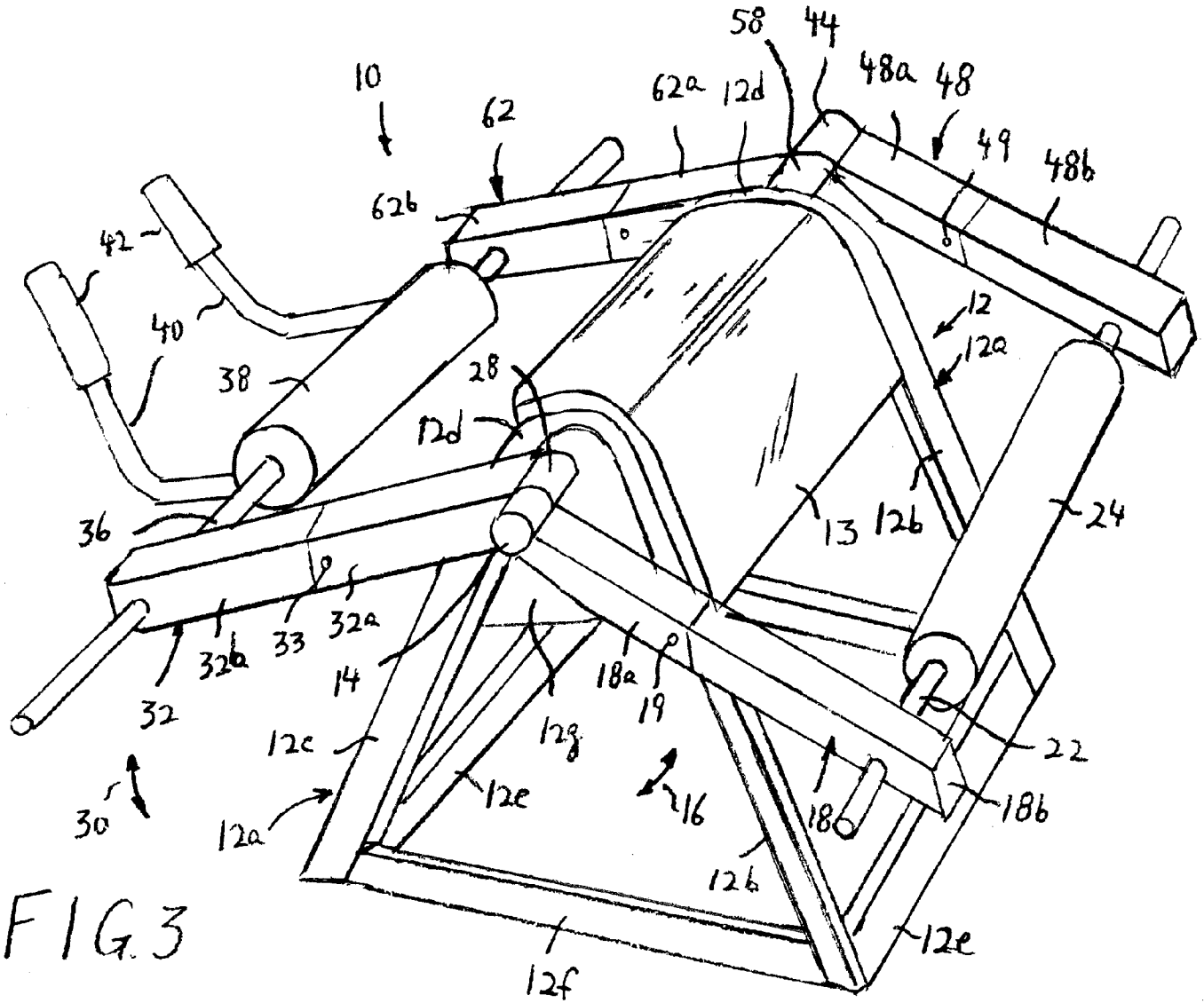
FIG. 3 is a perspective view of an exercise and/or rehabilitation machine according to a first modification of the present invention.

Referring now to FIG. 3, there is shown a modification to exercise and/or rehabilitation machine 10.

Specifically, a third pivot shaft 44 extends from the opposite side of upper cross support 12*g* and is rotatably mounted therein. An elongated arm 48 is connected to pivot shaft 44 and extends in a direction perpendicular to the axis of pivot shaft 44 toward leg 12*b* of the other end support 12*a* for rotation in the direction of double headed arrow 16. Elongated arm 48 is thereby in parallel, spaced apart relation to elongated arm 18. Elongated arm 48 can be formed by two telescoping arms 48*a* and 48*b* which can be set relative to each other by a pin, set screw or the like 49 to adjust the length of elongated arm 48. A stop (not shown) extending outwardly from leg 12*b* of the other end support 12*a*, limits the downward travel of elongated arm 48 and sets a lower limit thereof. The end of roller support bar 22 extending from the opposite end of cylindrical roller cushion 24 extends through the free end of elongated arm 48 in a direction transverse thereto. As an option, although not required by the present invention, roller support bar 22 extends through the opposite side of elongated arm 48 at the free end thereof in a direction away from support 12, whereby conventional weightlifting plates 100 can be slidably mounted on roller support bar 22, and a well known securing collar (not shown) can be added to hold the weights on roller support bar 22.

A second pivot shaft 28 is mounted in rotatable surrounding relation on pivot shaft 14 between arm 18 and upper cross support 12*g*. An elongated arm 32 is connected to pivot shaft 28 and extends in a direction perpendicular to the axis of pivot shaft 28 toward the other leg 12*c* of support 12 for rotation in the direction of double headed arrow 30. Elongated arm 32 can be formed by two telescoping arms 32*a* and 32*b* which can be set relative to each other by a pin, set screw or the like 33 to adjust the length of elongated arm 32. A stop 34 (FIG. 2) extending outwardly from leg 12*c* limits the downward travel of elongated arm 32 and sets a lower limit thereof. A roller support bar 36 extends from one side at the free end of elongated arm 32 in a direction in front of support 12 and includes a cylindrical roller cushion 38 rotatably mounted thereon. As an option, although not required by the present invention, roller support bar 36 extends through the opposite side of elongated arm 32 at the free end thereof in a direction away from support 12, and can also extend to the opposite side of cylindrical roller cushion 38, whereby conventional weightlifting plates 100 can be slidably mounted on roller support bar 36, and a well known securing collar (not shown) can be added to hold the weights on roller support bar 36.

The advantage of this arrangement is that the cylindrical roller cushions 24 and 38 are not supported in a cantilevered manner, and are thereby more stably supported.

Figure 4:
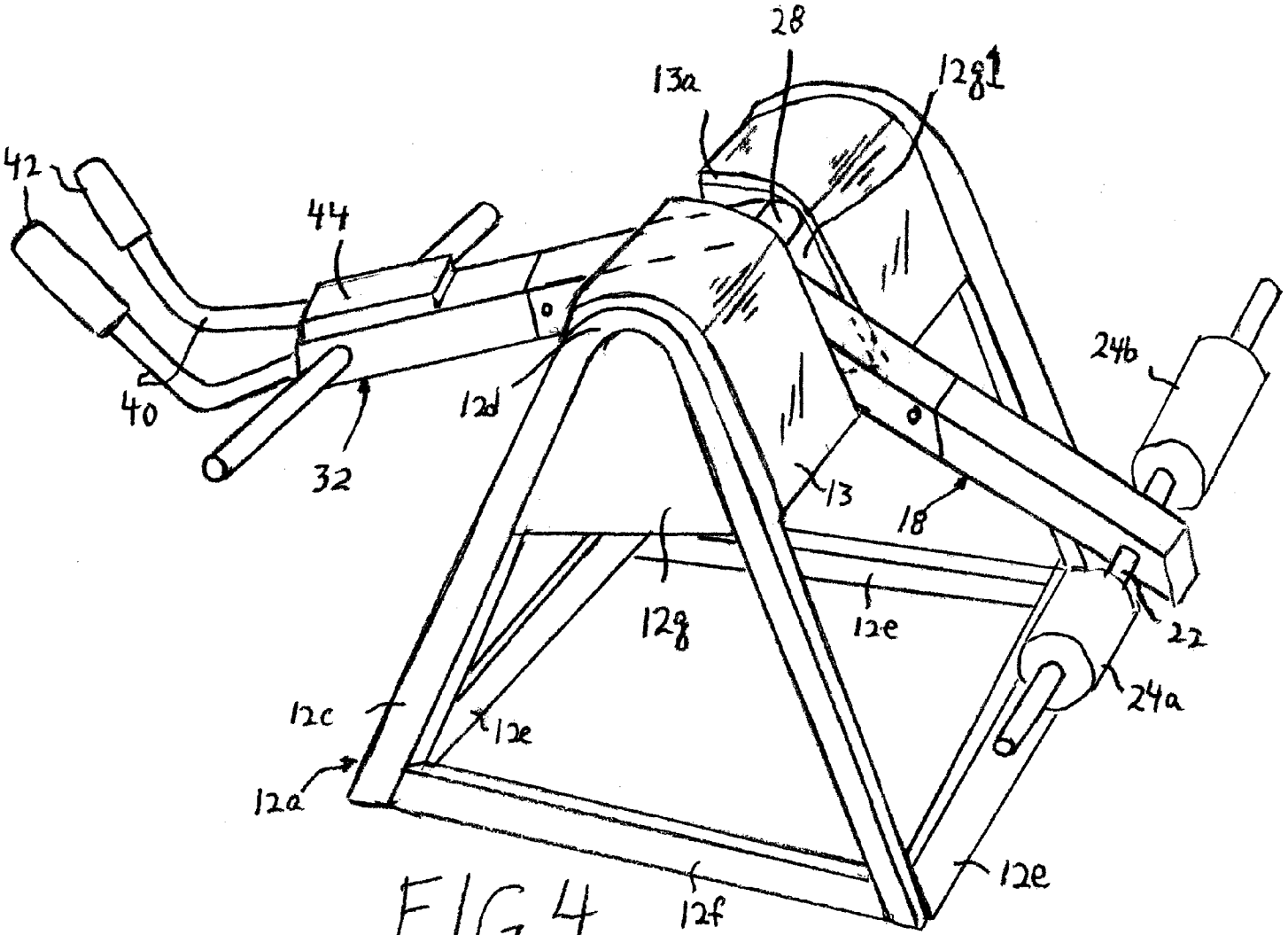
FIG. 4 is a perspective view of an exercise and/or rehabilitation machine according to a second modification of the present invention.

Alternatively, as shown in FIG. 4, the arrangement of FIG. 1 can be modified by cutting out a center section 12*g*1 of upper cross support 12*g* and a corresponding center section 13*a* of cushion 13, and pivotally mounting elongated arms 18 and 32 about pivot shafts 14 and 28 (the former of which is not shown in FIG. 4), to upper cross support 12*g* in center section 12*g*1 thereof. In such case, two cylindrical roller cushions 24*a* and 24*b* are mounted on roller support bar 22 at opposite sides of elongated arm 18 at the free end thereof. Roller support bar 22 also preferably extends to the opposite sides of cylindrical roller cushions 24*a* and 24*b*, whereby conventional weight-lifting plates (not shown) can be slidably mounted on roller support bar 22, and well known securing collars (not shown) can be added to hold the weights on roller support bar 22.

Further, rather than a cylindrical roller cushion 38 mounted to roller support bar 36, a flat cushion 44 is mounted on the upper surface of elongated arm 32 at the free end thereof for supporting the chest of the person.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. An exercise and/or rehabilitation machine comprising:

a stationary support for supporting a person's anterior pelvic area, a first extension pivotally connected to said support and extending in a first direction for engagement by a person's lower body, said first extension being connected to said support for pivotal movement during operation from a position below horizontal to a position at least to approximately horizontal relative to a surface on which the machine is supported, said first extension having a first arrangement for coupling a force resistance arrangement thereto which is adapted to apply a force that resists upward pivotal movement of said first extension, and a second extension pivotally connected to said support and extending in a second direction opposite to said first direction for engagement with a person's upper body while the first extension is engaged by the person's lower body, said second extension being connected to said support for pivotal movement during operation from a position below horizontal to a position at least to approximately horizontal relative to the surface on which the machine is supported, said second extension having a second arrangement for coupling a force resistance arrangement thereto which is adapted to apply a force that resists upward pivotal movement of said second extension, and said first and second extensions being connected to said support in a manner to pivot independently of each other during operation of the machine.

2. An exercise and/or rehabilitation machine according to claim 1, wherein said first arrangement and second arrangement each includes a bar at a free end of the first extension arm and second extension arm, respectively, for slidably mounting weight plates thereon as said force resistance arrangements.

3. An exercise and/or rehabilitation machine according to claim 1, wherein at least one of said force resistance arrangements includes at least one elastic cable connected between the respective one of said first and second arrangements and a fixed point.

4. An exercise and/or rehabilitation machine according to claim 1, wherein said support has one of the following:

a rounded upper surface for supporting the person's anterior pelvic area, and a flat upper surface for supporting the person's anterior pelvic area.

5. An exercise and/or rehabilitation machine according to claim 1, wherein said support has a general triangular framework.

6. An exercise and/or rehabilitation machine according to claim 1, wherein:

said first extension includes:

a first extension arm pivotally connected to said support, and a first engagement member connected to said first extension arm for engagement by the person's lower body, and said second extension includes:

a second extension arm pivotally connected to said support, and a second engagement member connected to said second extension arm for engagement by the person's upper body.

7. An exercise and/or rehabilitation machine according to claim 6, wherein each of said first and second extension arms are formed by telescoping arms to permit adjustment of a length of each respective first and second extension arm, and a securing element extending through the first and second extension arms for securing the telescoping arms relative to each other in order to adjust the lengths of said first and second extension arms.

8. An exercise and/or rehabilitation machine according to claim 6, wherein said first and second engagement members include cushion members at free ends of said first and second engagement members for engagement by the lower and upper body of the person, respectively.

9. An exercise and/or rehabilitation machine according to claim 8, wherein at least one of said cushion members extends generally perpendicular from the free ends of said first and second extension arms, respectively, for engagement by the lower and upper body of the person, respectively.

10. An exercise and/or rehabilitation machine according to claim 9, wherein said cushion members are mounted around axes thereof.

11. An exercise and/or rehabilitation machine according to claim 10, wherein one of said first and second extension arms includes two spaced apart and generally vertically aligned cushion members for receiving a person's legs therebetween.

12. An exercise and/or rehabilitation machine according to claim 11, wherein said one of said first and second extension arms includes a footplate for receiving a person's feet therein during operation.

13. An exercise and/or rehabilitation machine according to claim 10, wherein said first and second engagement members include a bar extending transversely through the free end of each of said first and second engagement members, and said cushion members are rotatably mounted about the respective said bar.

14. An exercise and/or rehabilitation machine according to claim 13, wherein each said bar extends through opposite sides of the respective said cushion member to permit weight plates to be mounted thereon as a respective said force resistance arrangement.

15. An exercise and/or rehabilitation machine according to claim 13, wherein said second extension includes two handles at a free end thereof for grasping by a person.

* * * * *